US007195099B2

(12) United States Patent
Harney

(10) Patent No.: US 7,195,099 B2
(45) Date of Patent: Mar. 27, 2007

(54) HINGED SUPPORTED ROOF SCAFFOLD

(75) Inventor: Donald Harney, Woodward, IA (US)

(73) Assignee: Regency Innovations, LLC, West Des Moines, IA (US)

( * ) Notice: Subject to any disclaimer, the term of this patent is extended or adjusted under 35 U.S.C. 154(b) by 542 days.

(21) Appl. No.: 10/669,999

(22) Filed: Sep. 24, 2003

(65) Prior Publication Data

US 2005/0072096 A1 Apr. 7, 2005

(51) Int. Cl.
*E04G 3/34* (2006.01)
*E04G 3/20* (2006.01)

(52) U.S. Cl. ..... 182/45; 182/106; 248/237

(58) Field of Classification Search ..... 182/45, 182/82, 113, 106; 248/237, 148; 256/59, 256/DIG. 6
See application file for complete search history.

(56) References Cited

U.S. PATENT DOCUMENTS

| | | | | | |
|---|---|---|---|---|---|
| 3,866,715 | A | | 2/1975 | Foulk | |
| 4,183,144 | A | | 1/1980 | Barmett, III | |
| 4,909,483 | A | * | 3/1990 | van Herpen | 256/59 |
| 5,647,451 | A | * | 7/1997 | Reichel | 182/45 |
| 5,718,305 | A | * | 2/1998 | Palmer | 182/45 |
| 5,988,578 | A | | 11/1999 | Davies | |
| 2002/0096395 | A1 | | 7/2002 | Garrett | |

* cited by examiner

*Primary Examiner*—Hugh B. Thompson, II
(74) *Attorney, Agent, or Firm*—Brett Trout

(57) ABSTRACT

A support member for roof scaffolding having a base plate that is designed to be secured to a roof deck. The base plate is operably connected to a hinged plate that carries on it a sleeve that is used to engage scaffolding. Because of the way the hinged plate is mounted onto the base plate, a wedged end plate is formed to allow the base plate to easily slip underneath a shingle on a roof. Furthermore, because of the hinged plate the scaffolding is able to be maintained at a right angle to the ground.

26 Claims, 4 Drawing Sheets

HINGED SUPPORTED ROOF SCAFFOLD

BACKGROUND OF THE INVENTION

This invention relates to a hinged support for roof scaffolding. More specifically, and without limitation this invention relates to compact hinged support that has a base plate that is designed to slide under a shingle on a roof so that the support member may be nailed to the deck of the roof to support scaffolding.

Since the first shingled roof was laid, roofers have been seeking ways in which to more easily work and have supplies on a slanted roof without damaging the roof. In the past individuals have attempted to use scaffolding in order to assist them in removing and replacing shingles on a roof. These scaffolding devices utilize complicated systems with large cumbersome bases to support scaffolding. For example, U.S. Pat. No. 3,866,715 to Foulk discloses a roofing platform that uses a large frame having many braces to support the scaffolding and platform of the disclosed device. Although this device accomplishes having a device that allows for scaffolding on the roof to assist in removing and replacing shingles, because of the very large base and brace members, hauling this device onto a roof can prove to be extremely dangerous. Other drawbacks of prior scaffolding support members is that they have been anchored into shingles in the roof causing damage to the roof. Therefore, it is desired in the art to provide for a scaffolding support member that is used on a roof top that is small and compact to provide for a safer, more efficient scaffold system and is used without damaging the shingles on the roof.

Thus, it is a primary object of the present invention to provide a roof scaffold support that improves upon the state of the art.

Yet another object of the present invention is to provide a method of supporting roof scaffold by wedging a roof scaffold support member underneath a pulled back shingle and anchoring the support member to the roof without damaging shingles.

Another object of the present invention is to provide a roof scaffold support member that is small and compact so that it may be easily transported on and off of a roof top.

Yet another object of the present invention is to use a roof deck as added support to a roof scaffold support member by securing the support member to the roof deck.

A further object of the present invention is to use a hinged roof scaffold support member in order to provide a scaffolding system that sits at a right angle compared to the ground level regardless of how steep a roof is.

These and other objects, features, or advantages of the present invention will become apparent from the specification and claims.

BRIEF SUMMARY OF THE INVENTION

The present invention is a support member for roof scaffolding. The support member is on a base plate that has an end plate that is able to be wedged underneath a shingle so that the base plate may be secured to a roof deck without harming shingles. The scaffold support member also has a hinged plate that has a sleeve secured to the plate that receives a scaffolding member. Because the sleeve is on a hinged plate, the scaffolding may be pivoted to form a right angle with the ground in order to provide proper support for the scaffolding.

DETAILED DESCRIPTION OF THE OF THE INVENTION

Figure 1:
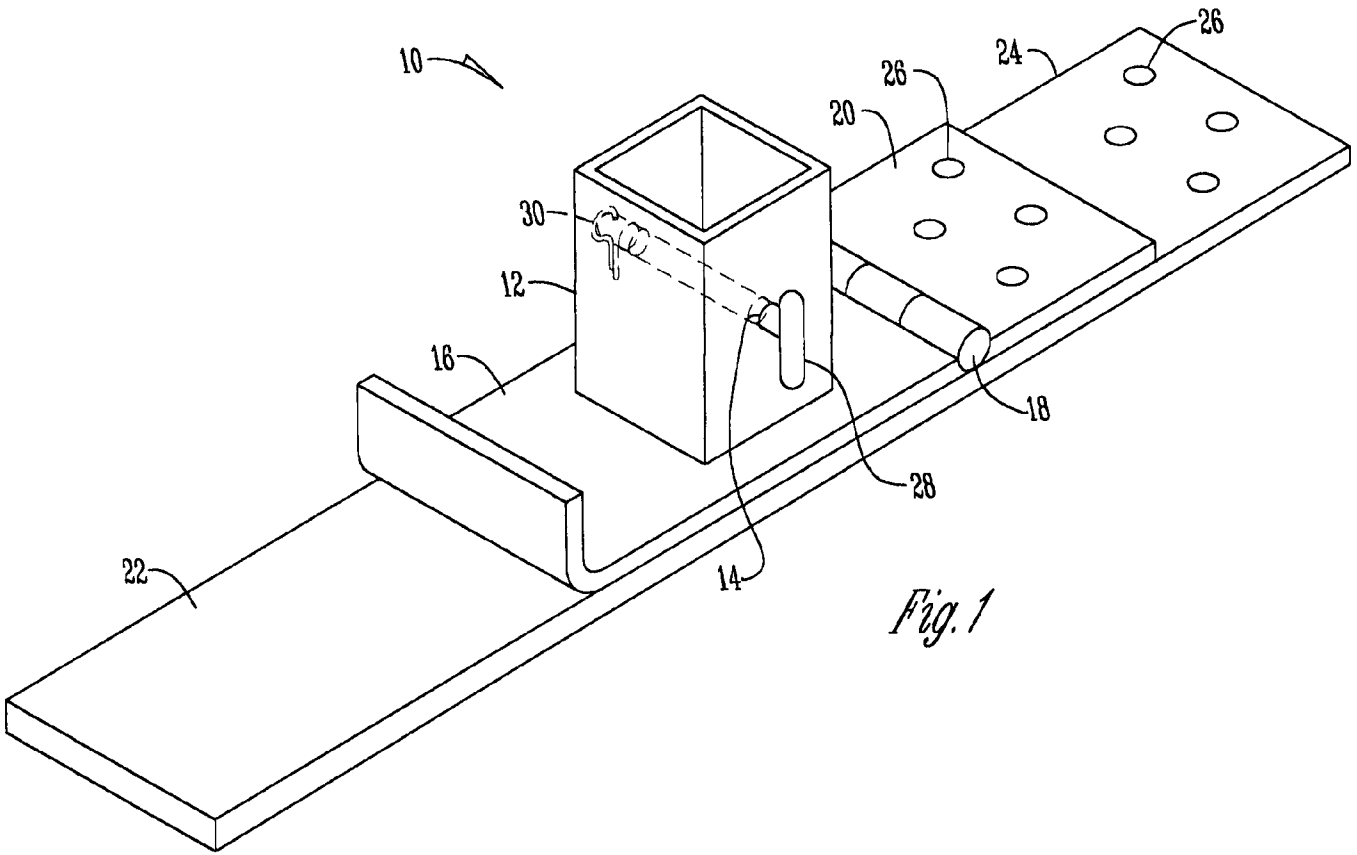
FIG. 1 is perspective view of the hinged roof scaffold support member of the present invention secured to a roof.
Figure 2:
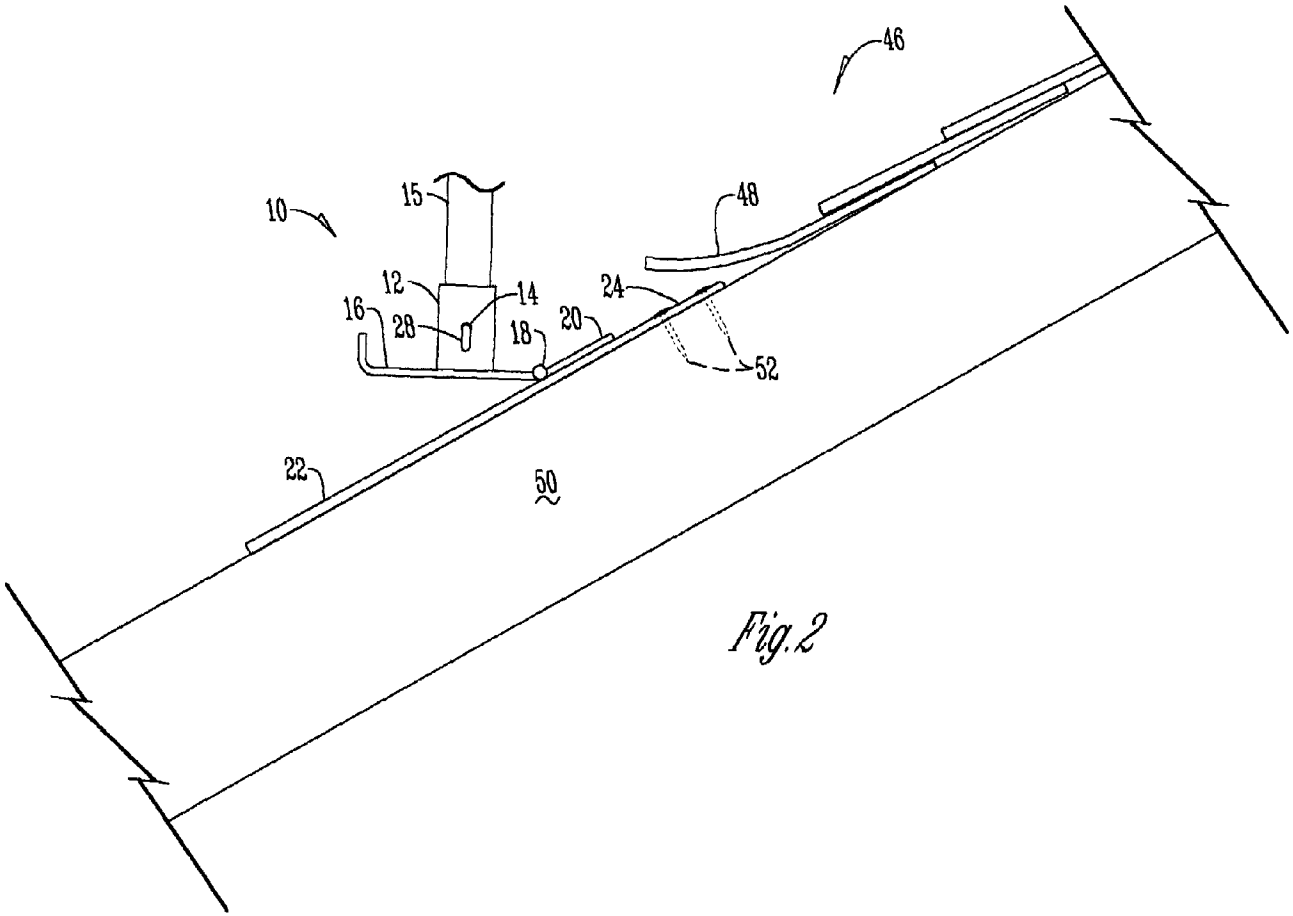
FIG. 2 is a side view of the hinged support member on a roof.

FIGS. 1 and 2 show the roof scaffold hinged support member 10 of the present invention. Support member 10 has a sleeve 12 with openings 14 that is adapted to receive scaffolding 15 and is located on top of a hinged plate 16. Hinged plate 16 is pivoted by hinge 18 that is rotatably connected to a plate 20. Plate 20 is operably connected to a base plate 22. Though the plate 20 and base plate 22 could be made from the same material, in a preferred embodiment the plate 20 is welded onto base plate 22. Because of the placement of the plate 20 on base plate 22, an end plate 24 that is part of base plate 22 is formed. Both end plate 24 and plate 20 have several openings 26. To secure scaffolding 15 within support member 10 a pin 28 having a cotter pin 30 is used.

Figure 3:
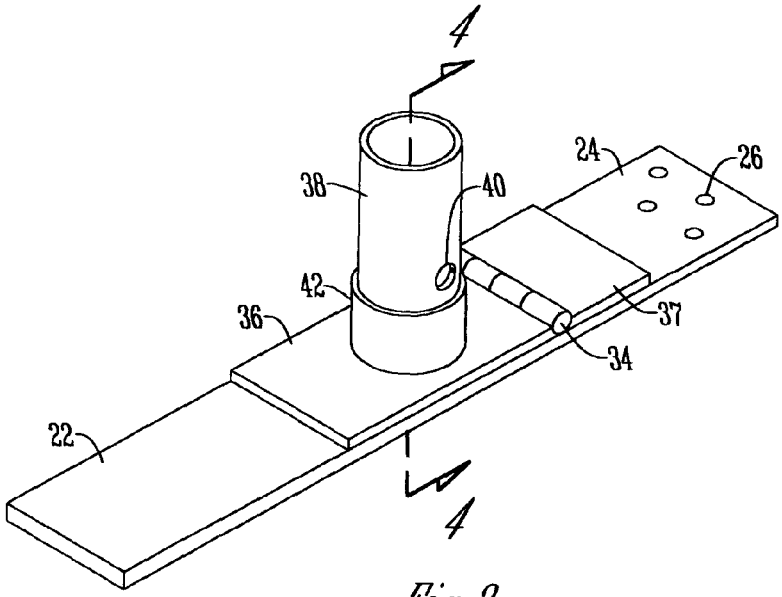
FIG. 3 is a perspective view of an alternate embodiment of the present invention.
Figure 4:
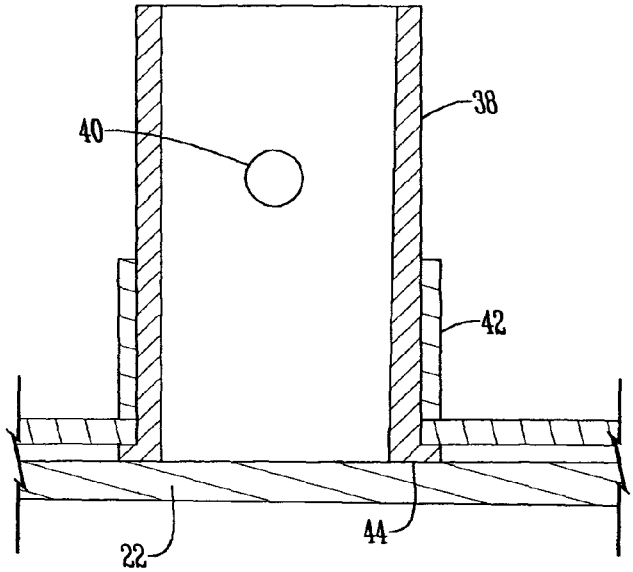
FIG. 4 is a sectional view taken along lines 4—4 of FIG. 3.

FIG. 3 shows an alternate embodiment of the present invention. As one can see, hinged plate 16 may be replaced depending on the type of scaffolding is needed for a certain application. A hinge 34 is rotatably connected to hinged plate 36 and plate 37. Plate 37 is secured to base plate by weld or any other securing means. The hinged plate 36 supports a tubular sleeve 38 having opening 40 and base member 42. The base member 42 is rotatably mounted within the hinged plate 36 so that an end portion 44 of the base 42 protrudes beyond the hinged plate 36. This allows the sleeve 38 to rotate. Because the tubular sleeve 38 rotates, its opening 40 is able to accommodate different types of scaffolding.

In operation the support member 10 is secured to a roof 46 by lifting shingle 48 to expose the roof deck 50. The end plate 24 is then wedged underneath the shingle 48 so that the end plate is adjacent to the exposed roof deck 50. Nails 52 are then driven through openings 26 into the roof deck 50 to support the support member 10. By pulling back the shingle 48 and wedging the end plate 24 under the shingle 48 the support member 10 is secured to the roof 46 without driving a nail through the shingle 48 or securing the support member 10 to the shingle 48. This allows a support member 10 to be secured to a roof 46 without damaging the roof 46. Scaffold 15 is then placed onto the sleeve 12 and is secured to sleeve 12 with pin 28. Because of hinge 18 scaffolding 15 is able to be positioned at a right angle compared to the ground regardless of the steepness of the roof 46.

It should be appreciated that because plate 20 is placed on top of base plate 22 end plate 24 forms a wedging type member that can easily slide underneath a pulled back shingle 48. Because of this wedged end piece 24 the base plate 22 can be easily secured to the roof deck 50 without damaging the roof 46. Also, because of the nails 52 securing the base plate 22 to the roof deck 50 and because of hinge 18, the support member 10 is able to support a scaffolding member 15 without using excess frame or base members. Consequently, support member 10 is compact and may be easily transported onto and off of roof 46. Therefore, all of the objectives of the present invention have been obtained.

Figure 5:
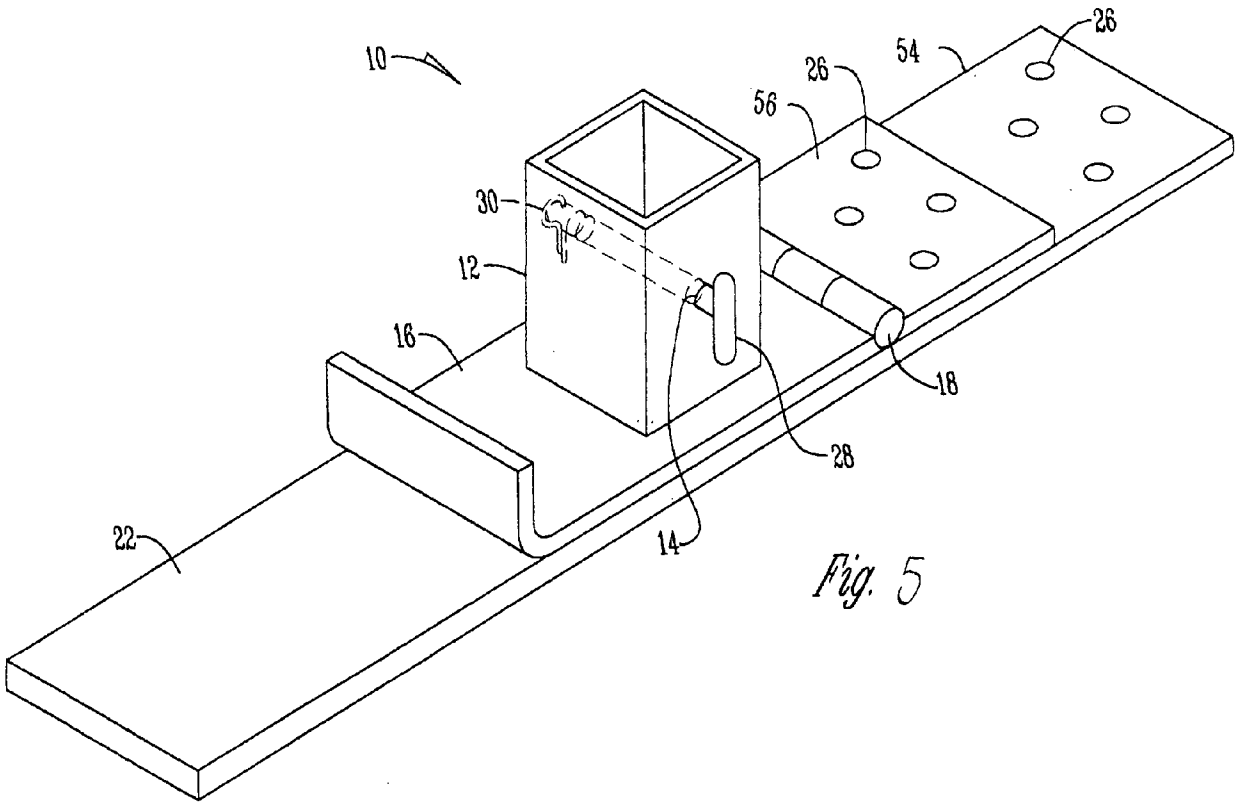
FIG. 5 is a perspective view of an alternative embodiment of the hinged roof scaffold support member of the present invention showing the plate and base plate being one piece.

FIG. 5 shows an alternative embodiment of the present invention with like numerals referring to like elements. In this embodiment, the end plate (54) and plate (56) are integrally formed of a single piece of metal to provide added stability.

It will be appreciated by those skilled in the art that other various modifications could be made to the device without the parting from the spirit in scope of this invention. All such modifications and changes fall within the scope of the claims and are intended to be covered thereby.

What is claimed is:

1. A support member for roof scaffolding comprising:
an elongated base plate having a first and second ends;
a plate securably connected to the base plate;
a hinge securably connected to the plate;
a hinged plate rotatably connected to the hinge;
a sleeve securably connected substantially normal to the hinged plate and adapted to receive roof scaffolding in a substantially coaxial orientation; and
wherein said base plate extends beyond said plate and below said hinged plate.

2. The support member of claim 1 wherein the first end of the elongated base plate has at least one opening disposed through the elongated base plate.

3. The support member of claim 2 further comprising securing means to secure the elongated base plate to a surface.

4. The support member of claim 3 wherein the surface is a roof deck.

5. The support member of claim 4 wherein the securing means is to nail nails through the opening in the elongated base plate into the roof deck.

6. The support member of claim 1 wherein the sleeve is an elongated rectangular tube body having a hollow interior.

7. The support member of claim 6 wherein at least one opening is disposed through the body of the sleeve.

8. The support member of claim 7 further comprising a supplemental opening disposed through the body of the sleeve.

9. The support member of claim 8 wherein a pin having a first end having a bore disposed therethrough is disposed through the opening in the rectangular tube body, the supplemental opening in the rectangular tube body and a bore of a scaffolding to secure said scaffolding to said sleeve.

10. The support member of claim 9 wherein a cotter pin is disposed through bore in the pin.

11. The support member of claim 1 wherein the sleeve is an elongated tubular member having a hollow interior.

12. The support member of claim 11 wherein the tube is adapted to securably receive scaffolding.

13. The support member of claim 11 wherein the tubular member is rotatably connected to the hinged plate.

14. The support member of claim 1 wherein the plate is welded to the base plate.

15. The support member of claim 1 wherein the sleeve is welded to the hinged plate.

16. The support member of claim 1 wherein the plate and the base plate are one piece.

17. The method of mounting scaffold onto a roof top having a roof deck and shingles comprising:
exposing the roof deck by bending a shingle upwardly from one end;
wedging a support member having a sleeve securably mounted on a hinged plate that is securably mounted onto a base plate that has a first end having at least one opening disposed therethrough underneath the shingle so that the first end of the base plate is adjacent to the exposed roof deck;
securing the support member to the roof by nailing a nail through an opening in the base plate into the roof deck;
releasing the shingle so that it covers the first end of the base plate, and
securing the scaffolding to the sleeve.

18. The method of claim 17 wherein the scaffolding is secured to the sleeve by inserting the scaffolding into the sleeve.

19. The method of claim 18 wherein the sleeve and scaffolding have openings disposed therethrough that align so that the scaffolding is secured to the sleeve using a pin element.

20. A support member for roof scaffolding comprising:
an elongated base plate;
a main plate securably connected to the base plate;
a hinge plate hinged to the main plate along a first axis;
a hinge securably connected to the plate; and
means journaled to the hinge plate along a second axis for receiving at least one leg of a roof scaffolding; and
wherein said first axis is different than said second axis.

21. A support member for a scaffolding comprising:
a base plate;
a hinge plate hinged to the base plate;
a sleeve coupled to said hinge plate; and
means coupled to the hinge plate for securing at least one leg of a roof scaffolding in an orientation substantially coaxial with the sleeve.

22. The support member of claim 21 wherein said securing means secures said at least one leg of a roof scaffolding onto said sleeve.

23. The support member of claim 21, wherein said securing means secures said at least one leg of a roof scaffolding into said sleeve.

24. The support member of claim 21, wherein said sleeve is less than forty centimeters long.

25. The support member of claim 21, wherein said receiving means comprises means for continuously supporting said at least one leg of a roof scaffold across at least twenty degrees of pivot of said at least one leg of a roof scaffold.

26. The support member of claim 21, wherein the scaffolding is adapted to be secured to the sleeve by sliding the scaffolding onto the sleeve.

* * * * *